US006032482A

United States Patent [19]

Krauss

[11] Patent Number: 6,032,482

[45] Date of Patent: Mar. 7, 2000

[54] CONSTRUCTIONAL COLLECTOR HEAT TRANSFER UNIT AND AIR CONDITIONER EQUIPPED THEREWITH

[75] Inventor: Hans-Joachim Krauss, Stuttgart, Germany

[73] Assignee: Behr GmbH & Co., Stuttgart, Germany

[21] Appl. No.: 08/915,760

[22] Filed: Aug. 21, 1997

[30] Foreign Application Priority Data

Aug. 31, 1996 [DE] Germany ..... 196 35 454

[51] Int. Cl.[7] ..... F25B 41/00; F28D 7/02

[52] U.S. Cl. ..... 62/513; 165/164

[58] Field of Search ..... 62/513, 509, 503; 165/163, 164, DIG. 398, 165 A

[56] References Cited

U.S. PATENT DOCUMENTS

| | | | |
|---|---|---|---|
| 1,833,664 | 11/1931 | Vandegrift | 165/163 |
| 3,830,077 | 8/1974 | Willen et al. | 62/238.1 |
| 3,955,375 | 5/1976 | Schumacher | 62/217 |
| 4,217,765 | 8/1980 | Ecker | 62/503 |
| 4,488,413 | 12/1984 | Bottum | 62/503 |
| 4,577,683 | 3/1986 | Kelch | 165/164 |
| 4,840,678 | 6/1989 | van der Schaaf | 165/163 |
| 4,895,203 | 1/1990 | McLaren | 165/163 |

FOREIGN PATENT DOCUMENTS

| | | |
|---|---|---|
| 1208314 | 1/1966 | Germany . |
| 60020708 | 1/1980 | Germany . |
| 4319293A1 | 12/1994 | Germany . |
| 4410986A1 | 1/1995 | Germany . |
| 1101268 | 1/1968 | United Kingdom . |
| 1127586 | 9/1968 | United Kingdom . |

OTHER PUBLICATIONS

Search Report Oct. 30, 1997 Great Britain.
Search Report Mar. 4, 1997 Germany.

*Primary Examiner*—William Wayner
*Attorney, Agent, or Firm*—Evenson, McKeown, Edwards & Lenahan, P.L.L.C.

[57] ABSTRACT

A constructional collector heat transfer unit having a fluid-carrying heat transfer unit and a collector for the intermediate refrigerant storage as well as an air conditioner with a refrigerant circulating system equipped therewith are provided. In the case of the constructional collector heat transfer unit 3 according to the invention, the heat transfer unit 6 is arranged in the interior of a housing 7*a* of the collector 7 such that the fluid guided through the heat transfer unit comes in a thermal contact with refrigerant intermediately stored in the collector and removed from it, fluid connection lines 13*a*, 13*b* for the heat transfer unit extending through the collector housing. By means of this constructional collector heat transfer unit air conditioners can be equipped with an interior heat transfer device.

5 Claims, 2 Drawing Sheets

CONSTRUCTIONAL COLLECTOR HEAT TRANSFER UNIT AND AIR CONDITIONER EQUIPPED THEREWITH

BACKGROUND AND SUMMARY OF THE INVENTION

This application claims the priority of German application 196 35 454.4 filed in Germany on Aug. 31, 1996, the disclosure of which is expressly incorporated by reference herein.

The invention relates to a constructional collector heat transfer unit having a refrigerant circulating system and to an air conditioner utilizing the heat transfer system. Heat transfer devices and refrigerant collector tanks, in the following called collectors, are known components of air conditioners having a refrigerant circulating system, as used, for example, in vehicles.

In German Published Patent Applications DE 43 19 293 A1 and DE 44 10 986 A1, constructional collector heat transfer units are described in the form of constructional collector heat transfer units for vehicle air conditioners in which a tube-shaped collector is arranged laterally on a condenser of a tube fin block construction and in this case is in a fluidity connection with an adjoining condenser collector tube. This known constructional collector condenser unit is intended for use in air conditioners in which the collector is positioned in the refrigerant circulating system on the high-pressure side behind the condenser.

On the other hand, air conditioners of the initially mentioned type are known in which the collector is arranged in the refrigerant circulating system on the low-pressure side behind the evaporator and a so-called interior heat transfer device is provided as an additional constructional unit by way of which the high-pressure side of the refrigerant circulating system between an air-cooled condenser and the expansion element is in a thermal contact with its low-pressure side between the collector and the compressor.

The invention is based on the technical problems of providing a new type of space-saving constructional collector heat transfer unit and an air conditioner equipped therewith which contains a collector arranged on the low-pressure side and an interior heat transfer device.

The invention solves these problems by providing a constructional collector heat transfer unit having a fluid-carrying heat transfer unit, and a collector for the intermediate storage of refrigerant, wherein the heat transfer unit is arranged in an interior space of a housing of the collector such that the fluid guided through the heat transfer unit comes in a thermal contact with the refrigerant through and intermediately stored in the collector, and wherein fluid connection lines for the heat transfer unit extend through the collector housing.

In the case of the constructional collector heat transfer unit, the fluid-carrying heat transfer device unit is arranged in the interior of the collector, that is, of the refrigerant collector tank, this unit being constructed and positioned such that the fluid guided through the heat transfer unit comes in a thermal contact with the refrigerant intermediately stored in the collector tank and removed from it. For the feeding and discharging of the fluid guided through the heat transfer device unit, corresponding connection lines are guided through the collector housing. In this manner, the constructional unit can be used for air conditioners in the case of which a heat transmission is to take place between the refrigerant which, after the intermediate storage in the collector, is to be transmitted and a fluid guided through the heat transfer unit, which fluid may in particular be the same refrigerant in a different section of the refrigerant circulating system but does not have to be that refrigerant.

In the case of certain preferred embodiments of a constructional collector heat transfer unit, the heat transfer unit is implemented by a tube construction with at least one flat-tube spiral having mutually spaced turns. The flat-tube spiral is inserted and axially covered in the collector housing such that the spiral space formed by the spaced flat-tube turns forms a spiral flow duct for the refrigerant removed from the collector. In this manner, the withdrawn refrigerant is in a thermal contact along the spiral turn path with the fluid guided in the interior of the flat tubes of the heat transfer unit.

In certain preferred embodiments, the heat transfer unit of the constructional collector heat transfer unit contains two flat-tube spirals which are arranged axially side-by-side separated by an intermediate bottom, these flat tube spirals being in a fluidity connection with one another by means of their two radially exterior ends or by means of their two radially interior spiral ends by way of a connection tube extending through the intermediate bottom. According to the selection of the connections, the flat-tube spirals may be fluidically connected in series or in parallel. Analogously, the two pertaining spiral-shaped flow ducts are connected by way of a connection opening in the intermediate bottom on mutually corresponding radial end areas and in this case, depending on the system design, are connected in series or in parallel.

The air conditioners according to preferred embodiments which are equipped with a constructional collector heat transfer unit whose collector on the low-pressure side is arranged in the refrigerant circulating system behind an evaporator, while the heat transfer unit operates as a so-called interior heat exchange device which is used for the heat transmission between the high-pressure and low-pressure side of the refrigerant circulating system. As a result, a compact construction of the air conditioner, particularly of the system part concerning the collector and the interior heat transfer device can be implemented. In comparison to conventional systems of this type with a constructional unit of the interior heat transfer device separated from the collector, the connection line which is required there is saved in addition to the connection points between the collector and the interior heat transfer device.

It was found that the inserting of such an interior heat transfer device, which causes a further cooling of the refrigerant on the high-pressure side behind the condenser connected with an overheating of the refrigerant taken in by the compressor on the low-pressure side, for certain air conditioners and refrigerants, permits an improvement of the refrigerating capacity and of the refrigerating capacity rate. In the case of air conditioners used for air-conditioning vehicles, the interior heat transfer device can also protect the compressor from damage caused by refrigerant taken in a liquid state.

In the case of a further development of preferred embodiments of an air conditioner, the interior heat transfer device on the low-pressure side is situated in the outlet-side flow path of the collector and can therefore cause, for example, an overheating of the refrigerant withdrawn from the collecting space.

Other objects, advantages and novel features of the present invention will become apparent from the following detailed description of the invention when considered in conjunction with the accompanying drawings.

DETAILED DESCRIPTION OF THE DRAWINGS

Figure 1:
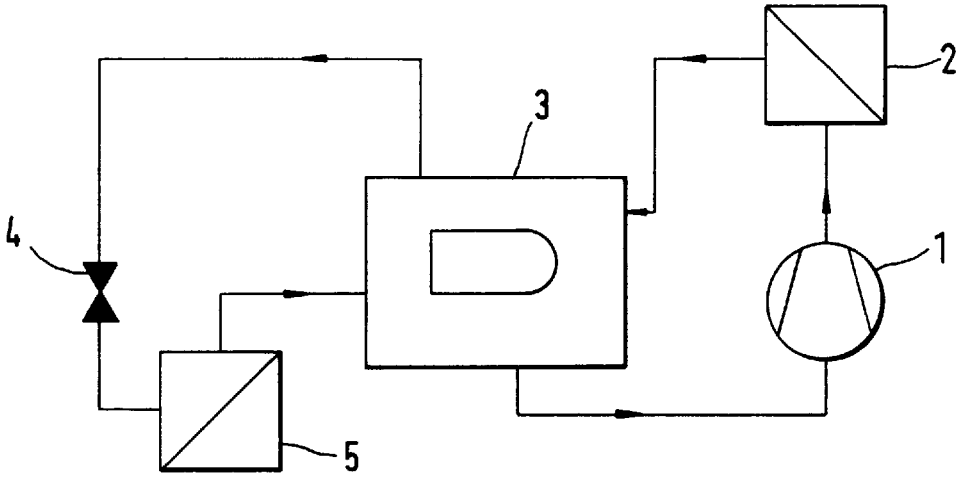
FIG. 1 is a block diagram of an air conditioner for air-conditioning a vehicle and having a constructional collector heat transfer unit constructed according to preferred embodiments of the present invention.

The air conditioner which is illustrated in the block diagram of FIG. 1 and which can be used for air-conditioning a vehicle contains a refrigerant circulating system with a suitable refrigerant. On the high-pressure side, the refrigerant travels from a compressor 1 into a condenser 2 in which it is cooled by an ambient air flow. Then it reaches an interior heat transfer device which is part of a constructional collector heat transfer unit 3, which will be described in detail below. From the output side of the interior heat transfer device of this constructional unit 3, the refrigerant is supplied to an expansion element 4. The expanded refrigerant is guided through an evaporator 5 against which air flows on the exterior side; this air is therefore cooled and used for air-conditioning the vehicle interior. On the low-pressure side, the refrigerant is guided from the evaporator 5 to the collector part of the constructional collector heat transfer unit 3 which collector part has the function of intermediately storing the refrigerant. The reason is that in different operating conditions, different refrigerant quantities are found in the high-pressure or low-pressure part of the system, and the respective differential quantities of refrigerant can be stored in the collector and removed from it. The compressor will then withdraw the respective required amount of refrigerant from the compressor 1.

By way of the interior heat transfer device of the constructional collector heat transfer unit 3, the pertaining high-pressure line section is in a thermal contact with the pertaining low-pressure line section, causing, on the one hand, a further cooling of the refrigerant on the high-pressure side in the flow direction behind the condenser 2 and, on the other hand, an overheating of the refrigerant sucked out of the collector by the compressor 1. It is found that, in the case of certain systems, the use of the interior heat transfer device permits an improvement of the refrigerating capacity and of the refrigerating capacity rate. Also, in this manner, the compressor may be protected from damage by refrigerant taken in the liquid state.

With the exception of the constructional collector heat transfer unit 3, the system of FIG. 1 is of a conventional nature and does not have to be explained in detail. The following will therefore be a specific discussion of the construction according to the invention of the constructional collector heat transfer unit 3 which combines two conventionally separated air conditioning components, specifically the collector and the heat transfer device in a special manner in a common constructional unit.

Figure 2:
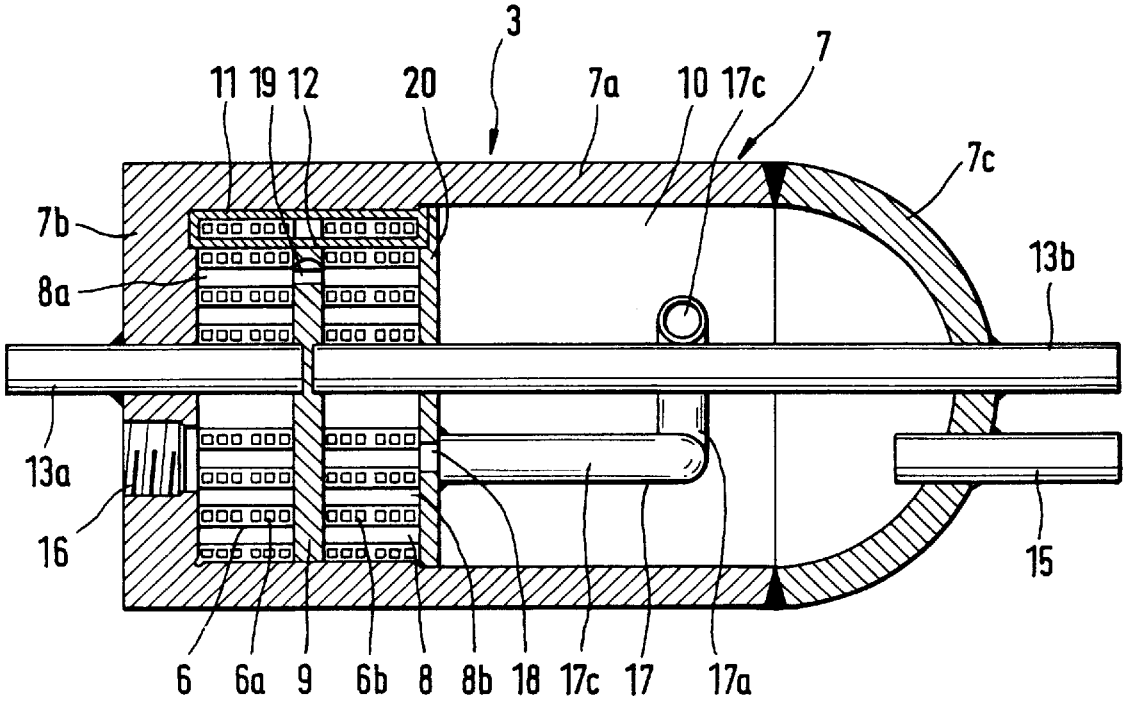
FIG. 2 is a longitudinal sectional view of the constructional collector heat transfer unit of FIG. 1.
Figure 3:
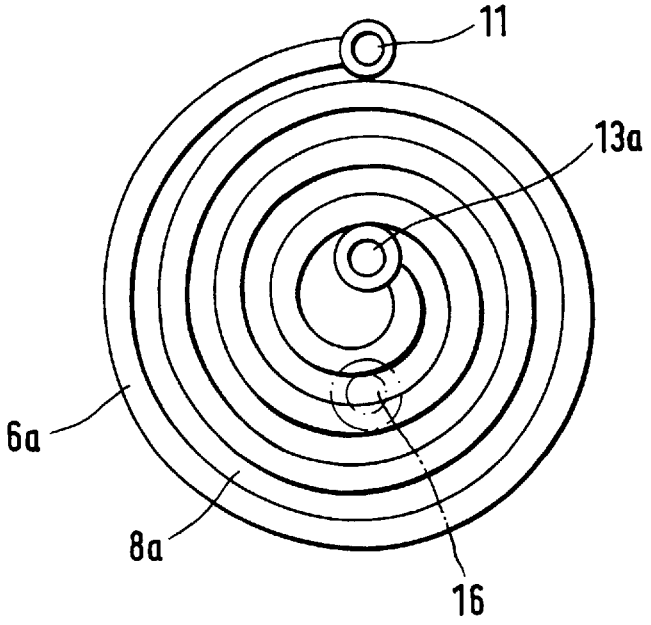
FIG. 3 is a schematic top view of the heat transfer device unit used in the constructional collector heat transfer unit of FIG. 2.
Figure 4:
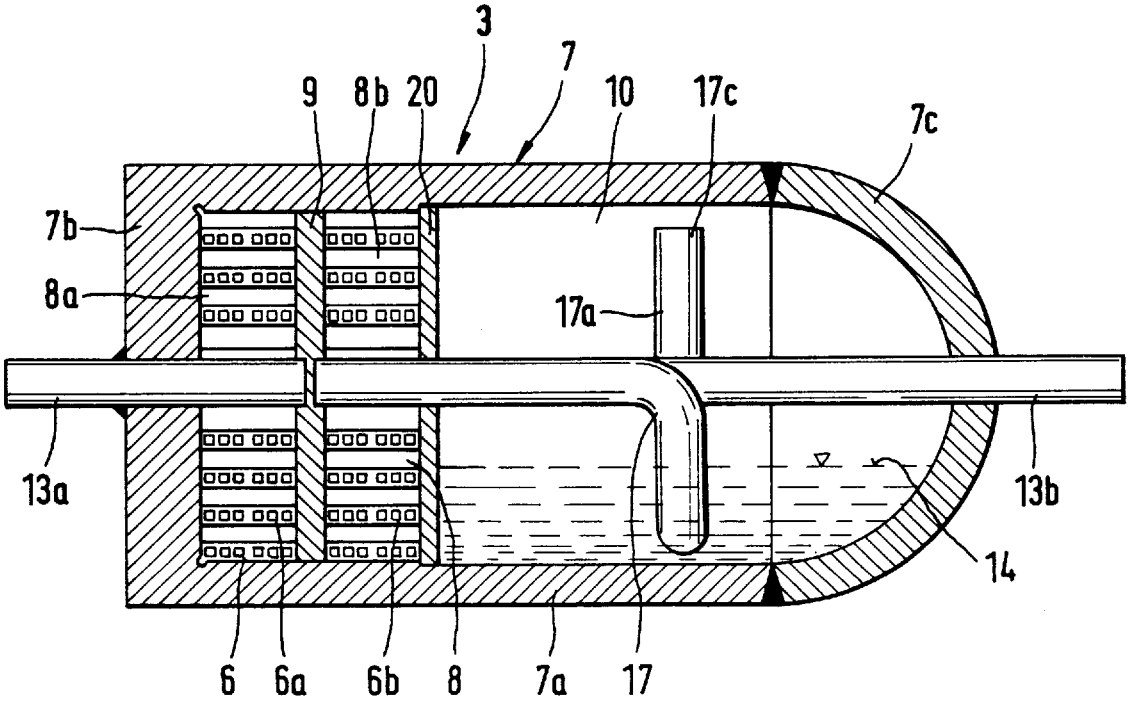
FIG. 4 is a longitudinal sectional view of the constructional collector heat transfer unit of FIG. 1 along a longitudinal sectional plate perpendicular to that of FIG. 2.

A preferred implementation of the constructional collector heat transfer unit 3 according to the invention is illustrated in FIGS. 2 to 4. In the case of this constructional unit 3, a heat transfer unit 6 which can be used as an interior heat transfer device for the system of FIG. 1 is integrated in a collector 7 in that it is arranged in a cylindrical collector housing 7*a* adjoining a housing bottom 7*b*,in which case the housing 7*a* is closed off on the opposite side by means of a welded-on curved cover 7*c*. As heat-transfer-active elements, the heat transfer unit 6 has two flat-tube spirals 6*a*, 6*b* of the same type which are each manufactured by a spiral winding of an extruded flat tube. The flat-tube spirals 6*a*, 6*b* are constructed with mutually spaced spiral turns so that the flat-tube exterior walls of each flat tube spiral 6*a*, 6*b* each define a corresponding spiral-shaped exterior space 8*a*, 8*b*. The two flat-tube spirals 6*a*, 6*b* are, in each case, entered into the collector housing 7*a* side-by-side in the axial direction with a spiral axis being parallel to the cylinder axis of the cylindrical collector housing 7*a*, in which case the two flat tube spirals 6*a*, 6*b* are separated from one another by way of an intermediate bottom 9. While one flat-tube spiral 6*a* rests against the bottom 7*b* of the collector housing 7*a*, a cover plate 20 closes off the heat transfer unit 6 on the opposite front face with respect to a refrigerant collecting space 10. On the one hand, the two flattube spirals 6*a*, 6*b* are fixedly connected with the intermediate bottom 9 and, on the other hand, with the bottom 7*b* of the collector housing 7*a* or with the cover plate 20 by means of soldering.

The two flat-tube spirals 6*a*, 6*b* are fluidically connected in series by way of a connection tube 11 which extends through a pertaining passage opening 12 in the intermediate bottom 9 and is provided with two longitudinal slots into which the exterior ends of the two flat-tube spirals 6*a*, 6*b* are fitted and seal-soldered. For an additional stabilizing of the position, the connection tube 11 is soldered to the interior side of the collector housing 7*a*. The guiding of the fluid in the heat transfer unit 6 therefore takes place from the radially interior end of the one flat-tube spiral to its radially exterior end; from there, by way of the connection tube 11, to the radially exterior end of the other flat tube spiral; and in the other flat tube spiral, toward the interior to its radially interior end. Toward the radially interior ends of the flat-tube spirals 6*a*, 6*b*, the connection tubes 13*a*, 13*b* are guided through corresponding bores in the collector housing 7*a* and are welded to the latter. The two connection tubes 13*a*, 13*b* are disposed separated by the intermediate bottom 9 in a line and, by means of the mutually facing ends, are embedded in recesses of the intermediate bottom 9. They are provided with one axial slot respectively in an adjoining tube section , into which axial slot the radially interior end of the pertaining flat-tube spiral 6*a*, 6*b* is fitted and seal-soldered.

As mentioned above, the collector function of the constructional collector heat transfer unit 3 is used for the intermediate storage of refrigerant. FIG. 4 shows a typical refrigerant liquid level 14 when the constructional collector heat transfer unit 3 is arranged with a horizontal longitudinal cylinder axis. On the one hand, a connection tube 15, which extends through the cover 7*c* of the collector housing 7*a* and is welded to it, is used as a connection for the refrigerant collecting space 10, by way of which connection tube 15, when used in the air conditioner of FIG. 1, the refrigerant is supplied which comes from the evaporator 5. On the other hand, a withdrawal tube 17 is provided which, by means of one end, ends in a U-shaped bend 17*a* situated transversely to the longitudinal cylinder axis of the collector housing 7*a*, which bend 17*a* extending with its curved center section provided with one or several inlet bores into the lower area of the refrigerant collecting space 10 and ending with an open end 17*c* in the upper area of the collecting space 10. On the other side, the U-shaped tube bend changes into an axial tube section 17*c* which is welded by means of its face to the cover plate 20 which there, in turn, has a passage bore 18 by way of which the withdrawal tube 17 is in a fluidity connection with the radially interior area of the adjoining spiral space 8*b*.

Furthermore, the two spiral spaces 8*a*, 8*b* are in a fluidity connection with one another by way of a bore 19 in the intermediate bottom 9 by means of their radially exterior end sections. By way of a connection bore 16 in the bottom 7*b* of the collector housing 7*a*, the adjoining spiral space 8*a* is connected to the outside by means of its radially interior end section. In this manner, the two spiral spaces 8*a*, 8*b* formed by the respective flat-tube spiral 6*a*, 6*b* which are axially closed off on the one side by the intermediate bottom 9 and, on the other side, by the housing bottom 7*b* or the cover plate 20 with the exception of the described connection and connecting openings, form two flow ducts, which are serially connected behind one another, for the refrigerant which is guided through the collector heat transfer unit 3 and is intermediately stored there. In this case, the refrigerant is in a thermal contact along its flow path through the spiral flow ducts 8*a*, 8*b* with the fluid guided through the interior of the flat-tube spirals 6*a*, 6*b*, for the purpose of which the flat tubes consist of a highly thermally conductive material.

The use of the illustrated constructional collector heat transfer unit 7 therefore permits a heat transmission between a fluid guided through the flat-tube spirals 6*a*, 6*b* and the refrigerant which is withdrawn again after the collection. In this case, depending on the connection of the constructional collector heat transfer unit 7 to the adjacent air-conditioning components, a heat transmission can be achieved in the countercurrent as well as in the co-current. In a preferred use for the system of FIG. 1, the high-pressure-side refrigerant flows through the flat-tube spirals 6*a*, 6*b* of the heat transfer unit 6 of the constructional collector heat transfer unit 3, while the refrigerant withdrawn by the compressor 1 after the previous intermediate storage from the constructional collector heat transfer unit 3 is guided in the countercurrent thereto through the flow ducts 8*a*, 8*b* which are connected behind one another. For this purpose, the constructional collector heat transfer device unit 3 is connected by means of its heat transfer connection 13*a*, which is on the left in FIGS. 2 and 4, to the refrigerant high-pressure line branching off the condenser 2 and is connected to the refrigerant high-pressure line leading to the expansion element 4 by means of its heat transfer connection 13*b* which is on the right in FIGS. 2 and 4. The low-pressure line coming from the evaporator 5 extends to the cover-side connection tube 15 of the constructional collector heat transfer unit 3, while the withdrawal line leading to the compressor 1 is connected to the housing-bottom-side connection bore 16. This results in the following course of the flow.

Coming from the condenser 2, on the high-pressure side, the refrigerant enters, for example, at a temperature of between approximately 30° C. and 80° C. and a pressure corresponding to the thermodynamic characteristics of the used refrigerant, by way of the inlet tube 13*a* into the radially interior end of the first flat-tube spiral 6*a* and then flows in a spiral manner through this spiral 6*a* radially to the outside to its radially exterior end where it changes by way of the connection tube 11 to the radially exterior end of the second flat-tube spiral 6*b*. From there, it flows in a spiral manner radially to the interior to the radially interior end of the second flat-tube spiral 6*b* and is then discharged again by way of the outlet tube 13*b* in a cooled state from the collector heat transfer unit 3.

On the low-pressure side, for example, at a temperature of between approximately −10° C. and +20° C. and a pressure corresponding to the thermodynamic characteristics of the used refrigerant, the refrigerant, by way of the inlet pipe 15 coming from the evaporator 5 enters into the collecting space 10 in which generally liquid as well as gaseous refrigerant is situated as well as possibly refrigerator oil if the system is filled properly. By way of one or several bores in the U-bend 17*a* of the withdrawal tube 17, as the result of the suction effect of the compressor 1, a defined flow rate of liquid refrigerant together with the refrigerant entering in a gaseous state by way of the open tube end 17*c* is sucked off. The refrigerant will then usually in two phases flow by way of the bore 18 in the cover plate 20 into the radially interior area of the adjoining spiral flow duct 8*b*; that is, close to the outlet area for the high-pressure-side refrigerant flow in the interior of the flat-tube spirals 6*a*, 6*b*. The low-pressure side refrigerant taken in by the compressor 1 will then flow in the countercurrent to the high-pressure-side refrigerant flow in this flow duct 8*b* radially to the outside until it changes in its radial exterior section by way of the connection bore 19 in the intermediate bottom 9 into the radial exterior area of the other flow duct 8*a* where it continues in the countercurrent to the high-pressure-side refrigerant flow in a spiral manner radially toward the interior, until, in the radially interior area, by way of the connection bore 16 in the housing bottom 7*b*, it leaves the constructional collector heat transfer unit 3.

When flowing through the flow ducts 8*a*. 8*b*, which are serially connected by way of the connection bore 19 in the intermediate bottom 9, the refrigerant taken in by the compressor is in a thermal contact with the high-pressure refrigerant flow guided through the interior of the flat-tube spirals 6*a*, 6*b* which are serially connected behind one another and is heated in the process so that it is generally overheated and possibly liquid refrigerant is largely evaporated before the refrigerant leaves the constructional collector heat transfer unit 3.

As mentioned above, the interior heat transfer device 6 integrated here in a refrigerant collecting tank by means of the constructional collector heat transfer unit improves the refrigerating capacity of the air conditioner of FIG. 1 by the additional refrigerant cooling on the high-pressure side and the suction gas overheating of the refrigerant on the low-pressure side. It is understood that the heat transmission in the interior heat transfer device 6, can take place instead of as described in the countercurrent, as an alternative, in the co-current, for the purpose of which the high-pressure-side connections 13*a*, 13*b* only have to be connected in an exchanged manner. Furthermore, it is understood that modifications in the construction of the constructional collector heat transfer unit 3 are also contemplated; for example, as required, heat conduction fins can be provided for a further improvement of the heat transmission between the turns of the flat-tube spirals 6*a*, 6*b*, that is, in the flow ducts 8*a*, 8*b*. As further variants, the two flat-tube spirals can be fluidically connected in parallel by corresponding modifications of the connections and/or can be connected with one another with their radially interior ends, in the latter case, the connections extending to their radially exterior ends. Analogous modifications are conceivable for the flow ducts 8*a*, 8*b*.

The illustrated and other constructional collector heat transfer units according to the invention can be used not only for the air conditioner of FIG. 1 but in any other air conditioner where the requirement exists of a heat transmission between the refrigerant intermediately stored in a refrigerant collecting tank and another fluid flow which does not necessary have to be part of the actual refrigerant circulation of the system.

Although the invention has been described and illustrated in detail, it is to be clearly understood that the same is by way of illustration and example, and is not to be taken by way of limitation. The spirit and scope of the present invention are to be limited only by the terms of the appended claims.

What is claimed is:

1. Constructional collector heat transfer unit for an air conditioner having a refrigerant circulating system, comprising:

a fluid-carrying heat transfer unit, and a collector for intermediate storage of refrigerant, wherein the heat transfer unit is arranged in an interior space of a housing of the collector such that the fluid guided through the heat transfer unit comes in a thermal contact with the refrigerant flowing through and intermediately stored in the collector, wherein fluid connection lines for the heat transfer unit extend through the collector housing, wherein the heat transfer unit has a tube construction with at least one flat-tube radial spiral, wherein the at least one flat-tube radial spiral has mutually spaced turns, and wherein covers are provided with suitable connection openings assigned axially on both sides to the flat-tube spiral such that the spiral space forms a spiral flow duct for the refrigerant flowing through and intermediately stored in the collector.

2. Constructional collector heat transfer unit for an air conditioner having a refrigerant circulating system, comprising:

a fluid-carrying heat transfer unit, and a collector for the intermediate storage of refrigerant, wherein the heat transfer unit is arranged in an interior space of a housing of the collector such that the fluid guided through the heat transfer unit comes in a thermal contact with the refrigerant flowing through and intermediately stored in the collector, wherein fluid connection lines for the heat transfer unit extend through the collector housing, wherein the heat transfer unit has a tube construction with at least one flat-tube spiral with mutually spaced turns, wherein covers are provided with suitable connection openings assigned axially on both sides to the flat-tube spiral such that the spiral space forms a spiral flow duct for the refrigerant flowing through and intermediately stored in the collector, and wherein the heat transfer unit comprises two axially spaced side-by-side flat-tube spirals with pertaining flow ducts, the flat-tube spirals being spaced from one another by an intermediate bottom which has a passage opening for a connection tube for connecting two ends of the two flat-tube spirals which are radially situated at the same level, as well as a connection opening for connecting two end areas of the two spiral-shaped flow ducts radially situated at the same level.

3. Air conditioner for a motor vehicle, comprising:

a refrigerant circulating system with a collector arranged on a low-pressure side behind an evaporator and in front of a compressor, an interior heat transfer device by way of which a high-pressure side of the refrigerant circulating system in front of an expansion element is in a thermal contact with the low-pressure side, wherein the collector and the interior heat transfer device are formed in an integrated manner by a constructional collector heat transfer unit with the heat transfer unit arranged in an interior space of a housing of the collector such that the fluid guided through the heat transfer unit comes in a thermal contact with the refrigerant through and intermediately stored in the collector, wherein fluid connection lines for the heat transfer unit extend through the collector housing, wherein the interior heat transfer device has a tube construction with at least one flat-tube radial spiral, and a withdrawal tube and a refrigerant withdrawal connection of the constructional collector heat transfer unit, wherein at least one flow duct is situated in the refrigerant flow path between said withdrawal tube, which receives refrigerant collected in a collecting space of the collector, and said refrigerant withdrawal connection of the constructional collector heat transfer unit.

4. Air conditioner for a motor vehicle, comprising:

a refrigerant circulating system with a collector arranged on a low-pressure side behind an evaporator and in front of a compressor, and an interior heat transfer device by way of which a high-pressure side of the refrigerant circulating system in front of an expansion element is in a thermal contact with the low-pressure side, wherein the collector and the interior heat transfer device are formed in an integrated manner by a constructional collector heat transfer unit with the heat transfer unit arranged in an interior space of a housing of the collector such that the fluid guided through the heat transfer unit comes in a thermal contact with the refrigerant through and intermediately stored in the collector, wherein fluid connection lines for the heat transfer unit extend through the collector housing, wherein the interior heat transfer device has a tube construction with at least one flat-tube radial spiral, wherein the at least one flat-tube radial spiral has mutually spaced turns, and wherein covers are provided with suitable connection openings assigned axially on both sides to the flat-tube spiral such that the spiral space forms a spiral flow duct for the refrigerant flowing through and intermediately stored in the collector.

5. Air conditioner for a motor vehicle, comprising:

a refrigerant circulating system with a collector arranged on a low-pressure side behind an evaporator and in front of a compressor, and an interior heat transfer device by way of which a high-pressure side of the refrigerant circulating system in front of an expansion element is in a thermal contact with the low-pressure side, wherein the collector and the interior heat transfer device are formed in an integrated manner by means of a constructional collector heat transfer unit with the heat transfer unit arranged in an interior space of a housing of the collector such that the fluid guided through the heat transfer unit comes in a thermal contact with the refrigerant through and intermediately stored in the collector, wherein fluid connection lines for the heat transfer unit extend through the collector housing, wherein the heat transfer unit has a tube construction with at least one flat-tube spiral with mutually spaced turns, wherein covers are provided with suitable connection openings assigned axially on both sides to the flat-tube spiral such that the spiral space forms a spiral flow duct for the refrigerant flowing through and intermediately stored in the collector, and wherein the heat transfer unit comprises two axially spaced side-by-side flat-tube spirals with pertaining flow ducts, the flat-tube spirals being spaced from one another by an intermediate bottom which has a passage opening for a connection tube for connecting two ends of the two flat-tube spirals which are radially situated at the same level, as well as a connection opening for connecting two end areas of the two spiral-shaped flow ducts radially situated at the same level.

* * * * *